US009657497B2

(12) United States Patent
Adams, IV

(10) Patent No.: US 9,657,497 B2
(45) Date of Patent: May 23, 2017

(54) DOOR SECURITY APPARATUS

(71) Applicant: Henry Allen Adams, IV, Denver, CO (US)

(72) Inventor: Henry Allen Adams, IV, Denver, CO (US)

( * ) Notice: Subject to any disclaimer, the term of this patent is extended or adjusted under 35 U.S.C. 154(b) by 37 days.

(21) Appl. No.: 14/880,261

(22) Filed: Oct. 11, 2015

(65) Prior Publication Data

US 2016/0102477 A1 Apr. 14, 2016

Related U.S. Application Data

(60) Provisional application No. 62/062,862, filed on Oct. 11, 2014.

(51) Int. Cl.
*E05C 3/02* (2006.01)
*E05B 13/00* (2006.01)
*E05B 65/00* (2006.01)

(52) U.S. Cl.
CPC ..... *E05B 13/005* (2013.01); *E05B 65/0014* (2013.01); *E05C 3/02* (2013.01)

(58) Field of Classification Search
CPC ... E05C 3/042; E05C 5/00; E05C 5/02; E05C 3/162; E05C 19/022; E05C 5/04; E05B 13/105; E05B 5/003; E05B 17/04; E05B 1/0038; Y10T 70/7576; Y10S 292/37; Y10S 70/39
USPC ..... 292/240, 78, 63–65, 194, 241, 242, 292/DIG. 12, DIG. 7
See application file for complete search history.

(56) References Cited

U.S. PATENT DOCUMENTS 3,862,773 A * 1/1975 Bisbing ..... E05C 19/022 292/70
3,992,907 A * 11/1976 Pilvet ..... E05B 17/04 70/222
4,556,244 A * 12/1985 Bisbing ..... E05B 17/0025 292/336.3
4,583,775 A * 4/1986 Bisbing ..... E05B 17/0025 292/64
6,116,660 A * 9/2000 Langkamp, Jr. ..... E05B 17/002 292/203
7,441,427 B2 * 10/2008 Vickers ..... E05B 17/0025 292/57
8,191,941 B2 * 6/2012 Ramsauer ..... E05B 9/08 292/194
2008/0141744 A1 * 6/2008 Desaphie ..... H01H 27/00 70/344

* cited by examiner

*Primary Examiner* — Mark Williams
(74) *Attorney, Agent, or Firm* — Roger A. Jackson

(57) ABSTRACT

A door security apparatus including an extension beam having a first and a second end portion with a latch to engage a door frame and the beam therethrough the door, also a cap having a void and a first toothed distal end and a proximal end that is affixed to the extension beam second end portion that is disposed within the void. Also a cover having a base with a second tooth and a sidewall extending from the base, the base having an aperture that the extension beam slides in, the second tooth is removably engagable to the first tooth, plus a spring for biasing the cap and cover apart resulting in free movement, and when the cap and cover are brought together the first and second teeth engage to allow the door to disengage through manual motion from the cover to the cap to the extension beam and latch.

4 Claims, 10 Drawing Sheets

DOOR SECURITY APPARATUS

RELATED PATENT APPLICATION

This application claims the benefit of U.S. provisional patent application Ser. No. 62/062,862 filed on Oct. 11, 2014 by Henry Allen Adams IV of Denver, Colo., U.S.

TECHNICAL FIELD

The present invention relates generally to door security devices and more particularly to a self-contained door security apparatus that requires no keys or tumbler combination to be remembered that provides increased protection against unauthorized opening of the door, thus placing the door into a more secured closed operational state. More specifically, the present invention of a door security apparatus that utilizes a mechanism to only manually selectively allow the door to go from a closed operational state to an open operational state via the user initialing a sequence of manual movements to release the door security apparatus and facilitate the door in going from the closed operational state to the open operational state.

BACKGROUND OF INVENTION

The use of door security devices is well known in the prior art. Most of the door security devices being utilized require the use of keys, magnetic cards, smart cards, or the knowledge of a tumbler combination (letter and/or numeric), all of which put a burden upon the user to retain either the keys, magnetic cards, smart cards, or memorize the tumbler combination. If the door security device does not require the aforementioned keys, cards, or combinations, the security of the device is based on a non-positive mechanical securing or the door, however, as the door security device is not positive it can be disabled by merely loosening the mechanism that attaches the security device to the door.

In looking at the prior art in U.S. Pat. No. 6,575,503 to Johansson, et al. disclosed is a keeper and a latch that secures a first member such as a door panel against a second member such as a corresponding frame. The keeper, see element 12 in FIG. 1, in Johansson is adapted for attachment to the second member and engages the latch in a fastened position, thus latching the slam latch element 10 against the keeper element 12 securing the door 102 in a closed position against the frame element 104. In Johansson, when the slam latch element 10 is positioned against the keeper element 12 as shown in FIG. 1, the engagement of the ratcheting teeth on the pawl element 16 and keeper element 12 provide holding force to retain the door element 102 in the closed state against the frame element 104, wherein coil spring element 110 adds extra holding force as between the keeper element 12 and the pawl element 16.

Further, in Johansson, the handle element 18 can retract, as shown in FIG. 13 or extend, as shown in FIG. 11, wherein the door element 102 will stay in the closed state and upon clockwise rotation of the handle element 18 thus retracting the pawl element 16 from the keeper element 12; the door element 102 can be opened by pulling the handle element 18. Thus, Johansson has a button and a latch, however, not specifically requiring a push and then a turn, however, the claim 1 states "using a predetermined movement of the knob" as when in the extended position, the knob is moved rotationally to unlatch the pawl, thus requiring two movements to unlatch the door, i.e. pulling the knob to an extended position and then rotating the knob.

Continuing in the prior art, in U.S. Pat. No. 5,180,201 to Hauber disclosed is a camper shell door latch which while locked from the outside is openable from within inside the camper shell by a push button nut element 38, which shifts out of locking engagement with a bushing shoulder of limited axial extent to free the latch for inside actuation. Wherein the purpose in Hauber is to make the door latch more theft proof via requiring axial force against the nut element 38 prior to applying rotational force against the inner handle element 46, thus making it difficult for a thief to push a hooking rod through a crack in the door opening and grabbing the inner handle element 46 and partially rotating the inner handle element 46 to open the door that is locked from the outside, however, allowing someone trapped inside the door to open the door by pushing the nut element 38 prior to turning the inner handle element 46, see FIG. 1. Thus, inside latch theft protection in Hauber can require pushing a button to rotate the latch or without any rotation, thus to prevent a rod from being inserted through a broken window to unlock the latch resulting in two movements required to unlock the door latch from inside the door while the outside of the door latch is locked.

Further, in the prior art in U.S. Pat. No. 4,978,152 to Bisbing disclosed is a positive position indicator that is used on a variety of non-rotatable, cabinet slam-action pawl latches is disclosed. The indicator in Bisbing uses stored spring forces, stored in a thin, twin-leafed flat spring having a plurality of spring bends therein, to react against a latch keeper attached to the cabinet frame. The stored spring forces in Bisbing cause a spring tab to dislodge the latch pawl from an adjacent flat surface and move the latch housing and cabinet door away from the frame, thus resulting in a door that springs away from the frame to assist in the door "popping open" upon unlatching. In closing the door in Bisbing, "slam latching" is facilitated meaning that non-rotation is not required of the handle allowing the door to be slammed shut.

Next, in the prior art in U.S. Pat. No. 4,689,976 to Larsen disclosed is a pop-up handle assembly having a base with a mounting panel and a tubular housing and a handle with a tubular stem that is axially movable within a hollow sleeve rotatable within the tubular housing. In Larsen, the handle mounts a key-plug which is depressible to release a lock pin carried by the tubular stem from engagement with a shoulder in the tubular housing whereby the handle pops-up, see going from FIG. 2A to FIG. 2C to an operative position under the urging of a spring. The key-plug is rotatable in Larsen between locked and unlocked positions and into an unlocked position that can be depressed to release the handle for movement without the use of a key. The handle assembly in Larsen has provision for pop-up of the handle from the inner side thereof to free the handle for rotation regardless of whether the key-plug is either locked or unlocked, so if the key button is depressed, but the handle must be used also to unlatch. Thus in referring to FIG. 2A in Larsen, it would be difficult for a thief to get a grasp upon the handle to initiate forced rotation to try to unlock the retracted handle assembly, wherein the key facilitates what is shown in FIG. 2C, thus allowing the handle to be rotated to unlock the handle assembly, thus having a single manual action of using the key and an automatic action of the handle extending via spring element 58.

Continuing, in the prior art in U.S. Pat. No. 4,556,244 to Bisbing disclosed a latch of the pull-up type for a cabinet door that is latched and unlatched by turning the latch handle in one direction or the other. In Bisbing, when the door is in latched position, rotating the latch handle in the unlatching direction initially causes a spring-biased shaft, which carries a latching pawl, to move axially inwardly. This inward movement in Bisbing of the shaft is permitted because a cam in the handle is moved rotationally to present downwardly sloping cam surfaces to opposite ends of a cam-follower pin which is mounted on the shaft near its outer end.

In Bisbing, the shaft is prevented from rotating on its own axis until a motion-control cross pin, which is also mounted on the shaft, is moved inwardly a sufficient distance to escape from axial motion-control slots in a support sleeve which is mounted on the door at an opening therein and through which the shaft passes. As soon as the motion-control pin in Bisbing emerges from the motion-control slots, it is able to move laterally into lateral arcuate motion-control recesses in the support sleeve, thereby to allow the shaft and the latch pawl to turn out of the way of the cabinet frame. To latch the door in Bisbing, the action described takes place in reverse order, this has turning of the handle to cause automatic axial movement of the latch shaft.

What is needed is a door security apparatus that provides some measure of positive security for keeping the door in the closed operational state. In particular a door security apparatus that would require a sequence of manual movements for placing the door into the open operational state from the closed operational state. This sequence of manual movements would endeavor to be for the most part child proof in that a small child could not comprehend the requirement of the sequence of manual movements, being akin to a Japanese "Trick Box" that requires a specific sequence of manual movements to open, wherein any deviation of this specific sequence of manual movements will not allow the box to be opened. Wherein, an older child or adult could comprehend the required sequence of manual movements thus being able to open a cabinet door for instance and gain access to the contents behind the cabinet door.

SUMMARY OF INVENTION

Broadly, the present invention is a door security apparatus that is for securing a door to a door frame, with the door security apparatus including an extension beam having a longitudinal axis, with the extension beam having a first end portion and an opposing second end portion, and with the longitudinal axis spanning therebetween the first end portion and the second end portion. Also included in the door security apparatus is a means for removably engaging the extension beam first end portion to the door frame, that is preferably in the form of a latch. Further included in the door security apparatus is a means for slidably engaging the extension beam first end portion to the door, that is preferably in the form of a bushing plate. In addition, in the door security apparatus there is a cap having a lengthwise axis, the cap including a distal end portion and an opposing proximal end portion with the lengthwise axis spanning therebetween. The cap distal end portion including a void disposed therein, the void being defined by the proximal end portion and a cap surrounding sidewall extending from the proximal end portion wherein the surrounding sidewall terminates at an extent of the distal end portion. The longitudinal axis and the lengthwise axis are co-axially positioned to one another with the cap proximal end portion affixed to the extension beam second end portion that is disposed within the void, with the extent including a first tooth.

In addition, the door security apparatus includes a cover having a longwise axis, the cover including a base and a cover surrounding sidewall extending from the base, wherein the base forms a base plane with the base plane being positioned perpendicular to the longwise axis and the cover surrounding sidewall being about the longwise axis. The cover base having an aperture therethrough that the extension beam second end portion is slidably disposed within the aperture, the longwise axis and the longitudinal axis are co-axially positioned to one another and a portion of the cover surrounding sidewall is slidably engaged outside of a portion of the cap surrounding sidewall, further a second tooth disposed on the base, wherein the second tooth is removably engagable to the first tooth.

Further included in the door security apparatus is a means for biasing the cap and cover apart from one another along the lengthwise and longwise axes, wherein operationally when the cap and the cover are apart from one another the first tooth and the second tooth are disengaged from one another, thus the cap and the cover move freely in relation to one another. Wherein when the cover is manually pulled toward the cap along the lengthwise and longwise axes the first tooth and the second tooth removably engage one another facilitating a manual motion to transmit from the cover to the cap and ultimately the motion to transmit to the extension beam to accommodate engaging the door to the door frame. Plus, with a reverse motion to accommodate disengaging the door from the door frame, thus the door security apparatus requiring two independent manual movements being the pulling movement and the motion being required to engage and disengage the door from the door frame.

These and other objects of the present invention will become more readily appreciated and understood from a consideration of the following detailed description of the exemplary embodiments of the present invention when taken together with the accompanying drawings, in which;

REFERENCE NUMBERS IN DRAWINGS

Figure 1:
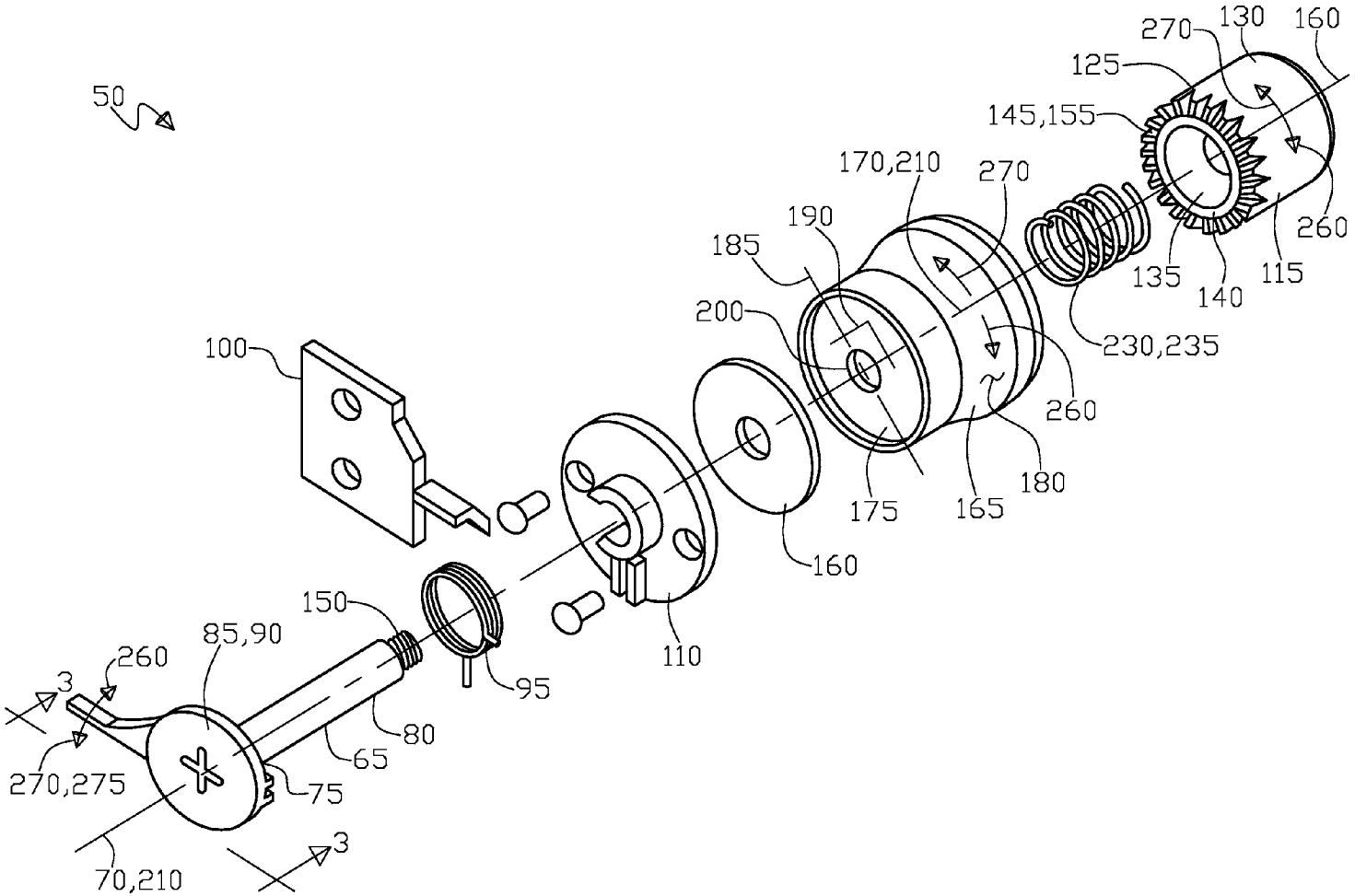
FIG. 1 shows an exploded perspective view of the door security apparatus that includes a means for removably engaging an extension beam that has a first end portion and a second end portion to a door frame, a cap having a distal end portion, a proximal end portion, a void, a cap surrounding sidewall, an extent with a first tooth, a cover with a base, a cover surrounding sidewall, and an aperture, wherein the co-axial positioning of a longitudinal axis, a longwise axis, and a lengthwise axis are shown, also manual motion and reverse manual motion that transmits from the cover to the cap to the extension beam and finally to the means for removably engaging the extension beam that is shown as a latch.

50 Door security apparatus
55 Door
60 Frame of the door 55
65 Extension beam
70 Longitudinal axis of the extension beam 65
75 First end portion of the extension beam 65
80 Second end portion of the extension beam 65
85 Means for removably engaging the extension beam 65 first end portion 75 to the door frame 60
90 Latch for means 85 for removably engaging the extension beam 65 first end portion 75 to the door frame 60
95 Rotational spring
100 Receiver of the frame 60 of the door 55 for the latch 90
105 Means for slidably engaging the extension beam 65 first end portion 75 to the door 55
110 Bushing plate for means 105 for slidably engaging the extension beam 65 first end portion 75 to the door 55
115 Cap
120 Lengthwise axis of the cap 115
125 Distal end portion of the cap 115
130 Proximal end portion of the cap 115
135 Void of the cap 115
140 Surrounding sidewall of the cap 115
145 Extent of the distal end portion 125
150 Affixment of the cap proximal end portion 130 to the extension beam second end portion 80
155 First tooth of the extent 145
160 Washer between the door 55 and the base 175
165 Cover
170 Longwise axis of the cover 165
175 Base of the cover 165
180 Surrounding sidewall of the cover 165
185 Plane of the base 175
190 Perpendicular position of the base plane 185 to the longwise axis 170
195 About positioning of the cover surrounding sidewall 180 to the longwise axis 170
200 Aperture of the cover base 175
205 Slidable disposition of the extension beam 65 second end portion 80 to the aperture 200
210 Co-axial position of the longwise axis 170, the longitudinal axis 70, and the lengthwise axis 120
215 Portion of the cover surrounding sidewall 180 being slidably engaged to an outside of a portion of the cap surrounding sidewall 140
220 Second tooth disposed on the base 175
225 Removable engagement of the first tooth 155 to the second tooth 220
230 Means for biasing the cap 115 and cover 165 apart from one another along the lengthwise 120 and longwise 170 axes
235 Axial spring for means 230 for biasing the cap 115 and cover 165 apart from one another along the lengthwise 120 and longwise 170 axes
240 Cap 115 and cover 165 are apart from one another in a separated state
245 Free movement of cap 115 and cover 165 to one another in the separated state 240
250 Manually pulling the cover 165 along the lengthwise 120 and longwise 170 axes
255 First 155 and second 220 teeth removably engaged to one another when the cap 115 and cover 165 are in the together state
260 Manual motion transmitting from cover 165 to cap 115 to extension beam 65 to engage door 55 to frame 60 of the door 55
265 Engaging door 55 to frame 60 of the door 55

270 Manual reverse motion transmitting from cover 165 to cap 115 to extension beam 65 to disengage door 55 to frame 60 of the door 55
275 Disengaging door 55 to frame 60 of the door 55
280 Alternative embodiment of the door security apparatus
285 Rotational axis
290 Shouldered rod
295 Wound spring
300 Knob
305 Bracket for the door 55
310 Tab
315 Fastener as between the shouldered rod 290 and the tab 310

DETAILED DESCRIPTION

With initial reference to FIG. 1, shown is an exploded perspective view of the door security apparatus 50 that includes the means 85 for removably engaging the extension beam 65 that has the first end portion 75 and the second end portion 80 to a door frame 60. Also, FIG. 1 shows the cap 115 having the distal end portion 125, a proximal end portion 130, the void 135, the cap surrounding sidewall 140, an extent 145 with the first tooth 155, the cover 165 with the base 175, the cover surrounding sidewall 180, and the aperture 200. Further, FIG. 1 shows the co-axial positioning 210 of the longitudinal axis 70, the longwise axis 170, and the lengthwise axis 120, also the manual motion 260 and reverse manual motion 270 that transmits from the cover 165 to the cap 115 to the extension beam 65 and finally to the means 85 for removably engaging the extension beam 65 that is shown as a latch 90.

Figure 2:
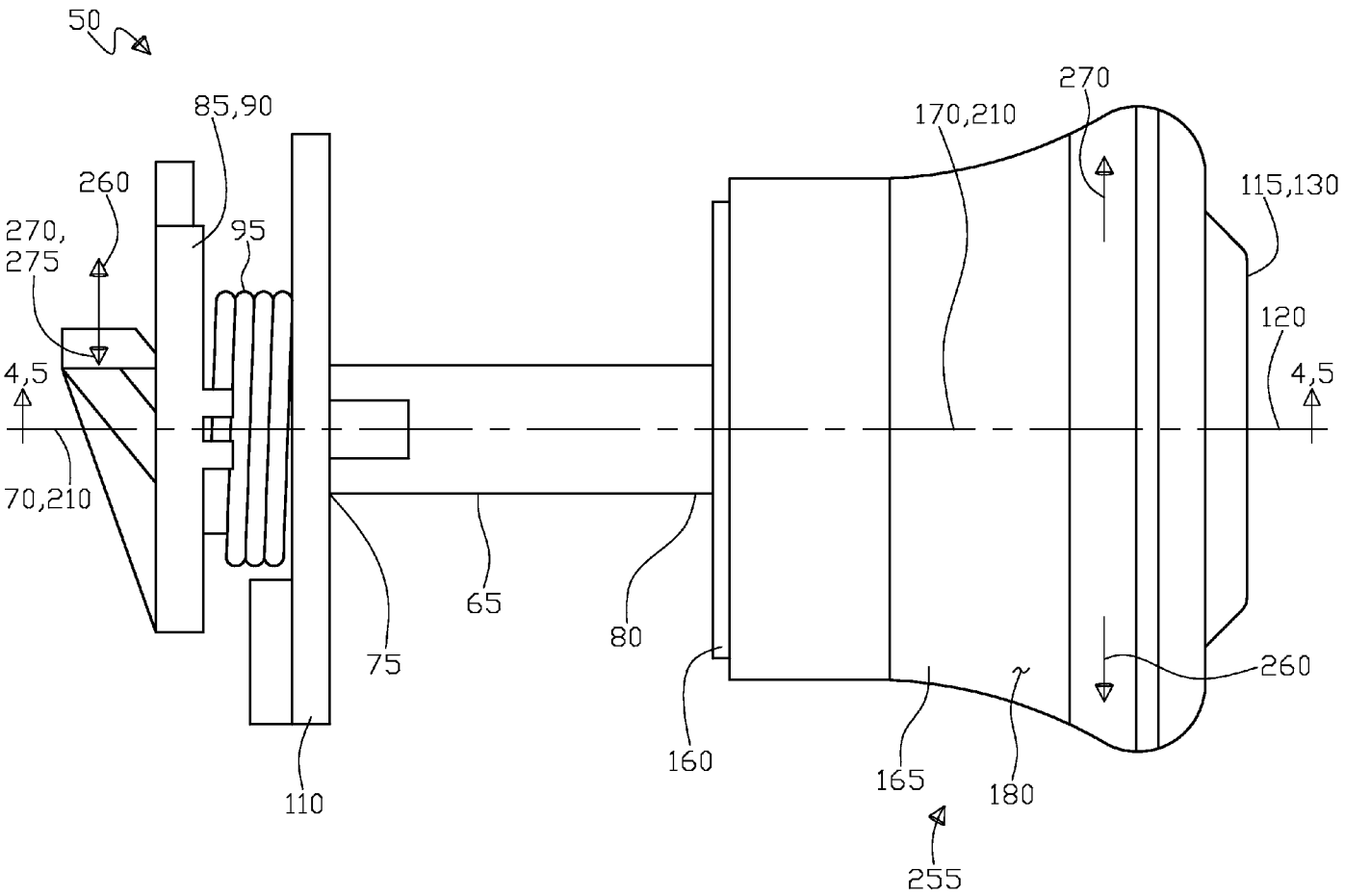
FIG. 2 shows an assembled side elevation view of the door security apparatus including the means for removably engaging the extension beam that has the first end portion and the second end portion to a door frame (not shown), a together state of the cap and the cover that allows for the manual motion and reverse manual motion that transmits from the cover to the cap to the extension beam and finally to the means for removably engaging the extension beam that is shown as a latch, further the co-axial positioning of the longitudinal axis, the longwise axis, and the lengthwise axis are shown.

Continuing, FIG. 2 shows an assembled side elevation view of the door security apparatus 50 including the means 85 for removably engaging the extension beam 65 that has the first end portion 75 and the second end portion 80 to a door frame 60 (not shown). In addition, FIG. 2 shows the a together state 255 of the cap 115 and the cover 165 that allows for the manual motion 260 and reverse manual motion 270 that transmits from the cover 165 to the cap 115 to the extension beam 65 and finally to the means 85 for removably engaging the extension beam 65 that is shown as a latch 90. Also, FIG. 2 shows the co-axial positioning 210 of the longitudinal axis 70, the longwise axis 170, and the lengthwise axis 120.

Figure 3:
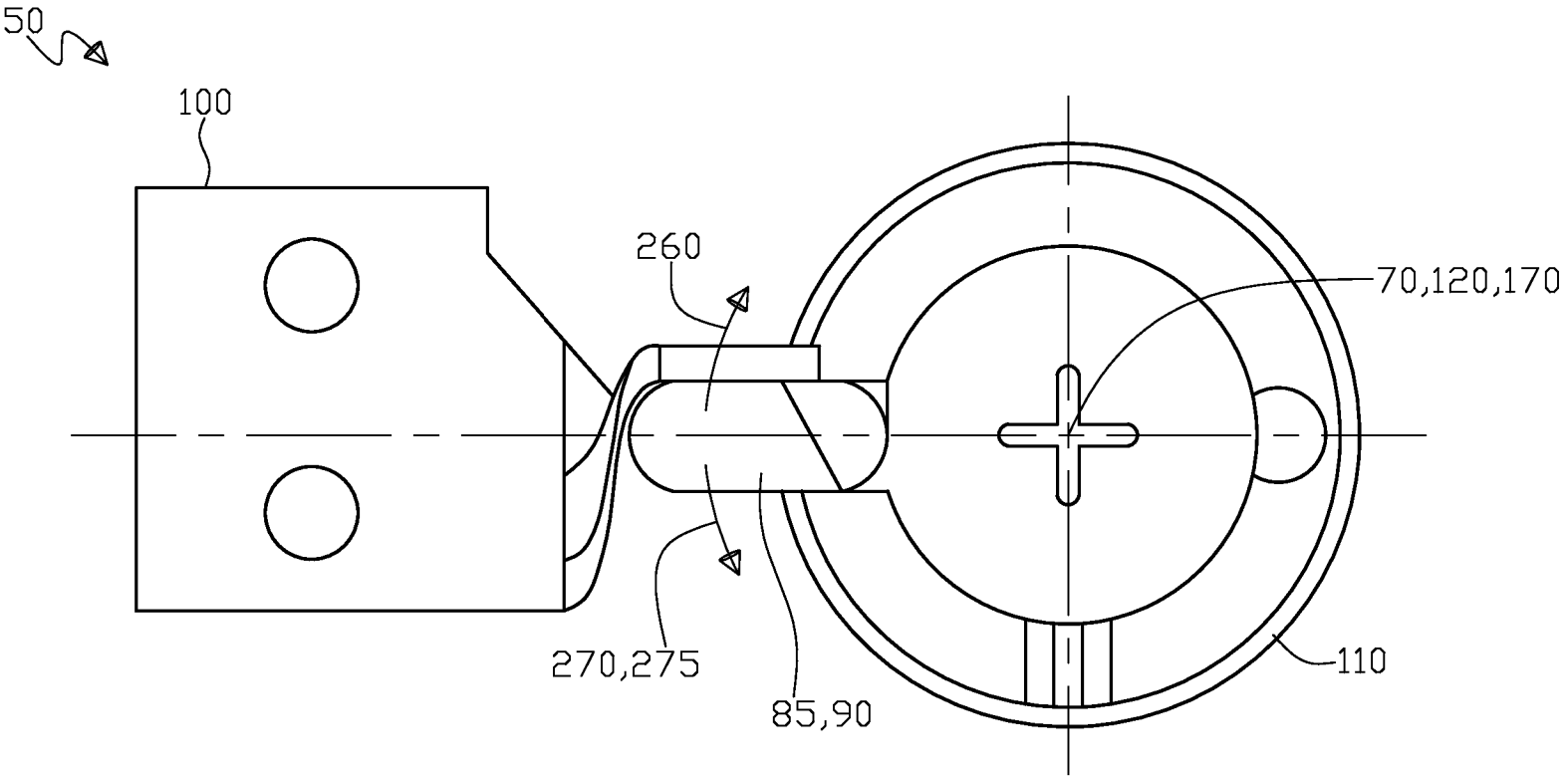
FIG. 3 shows view 3-3 from FIG. 1 that is an end assembled view of the door security apparatus that better shows the manual motion and reverse manual motion that transmits from the cover to the cap to the extension beam and finally to the means for removably engaging the extension beam that is shown as a latch that removably engages a receiver that is affixed to the door frame, further the co-axial positioning of the longitudinal axis, the longwise axis, and the lengthwise axis are shown.

Next, FIG. 3 shows view 3-3 from FIG. 1 that is an end assembled view of the door security apparatus 50 that better shows the manual motion 260 and reverse manual motion 270 that transmits from the cover 165 to the cap 115 to the extension beam 65 and finally to the means 85 for removably engaging the extension beam 65 that is shown as a latch 90 that removably engages the receiver 100 that is affixed to the door frame 60. Further, FIG. 3 shows the co-axial positioning 210 of the longitudinal axis 70, the longwise axis 170, and the lengthwise axis 120.

Figure 4:
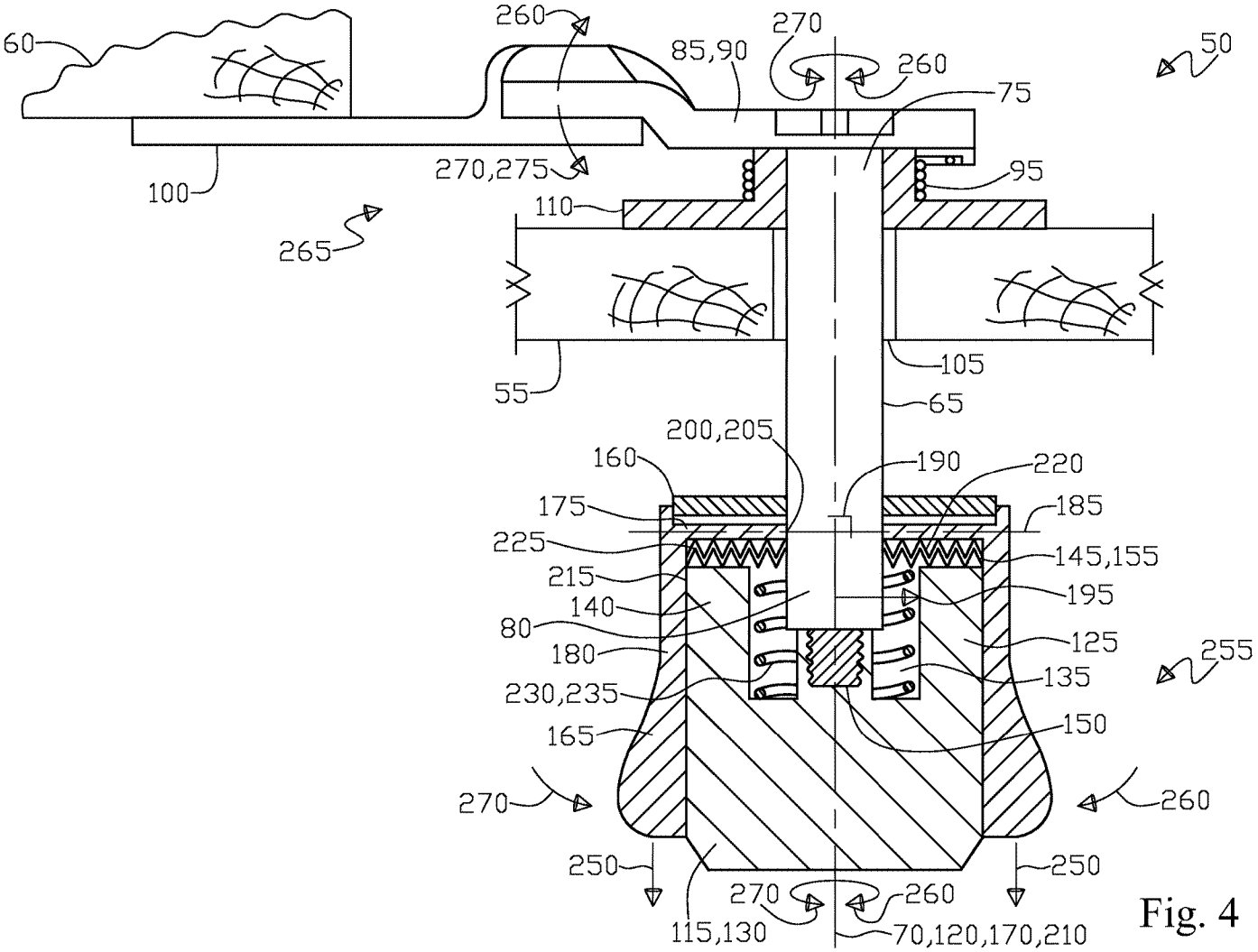
FIG. 4 shows cross section cut view 4-4 from FIG. 2 of the door security apparatus that includes portions of the door and the door frame, with the door frame affixed to the receiver and the door affixed to a bushing plate with the rotational spring that acts to rotationally bias manual motion toward engaging the door to the door frame as shown, in addition shown is the together state of the cap and the cover that allows for the manual motion and reverse manual motion that transmits from the cover to the cap to the extension beam and finally to the means for removably engaging the extension beam that is shown as a latch, further the co-axial positioning of the longitudinal axis, the longwise axis, and the lengthwise axis are shown, also shown is the first and second teeth that are removably engaged via the manually pulling of the cover along the lengthwise and longwise axes.

Moving onward, FIG. 4 shows cross section cut view 4-4 from FIG. 2 of the door security apparatus 50 that includes portions of the door 55 and the door frame 60, with the door frame 60 affixed to the receiver 100 and the door 55 affixed to a bushing plate 110 with the rotational spring 95 that acts to rotationally bias manual motion 260 toward engaging the door 55 to the door frame 60 as shown. In addition, FIG. 4 shows the together state 255 of the cap 115 and the cover 165 that allows for the manual motion 260 and reverse manual motion 270 that transmits from the cover 165 to the cap 115 to the extension beam 65 and finally to the means 85 for removably engaging the extension beam 65 that is shown as a latch 90. Also, FIG. 4 shows the co-axial positioning 210 of the longitudinal axis 70, the longwise axis 170, and the lengthwise axis 120, also shown is the first 155 and second 220 teeth that are removably engaged 225 via the manually pulling 250 of the cover 165 along the lengthwise 120 and longwise axes 170.

Figure 5:
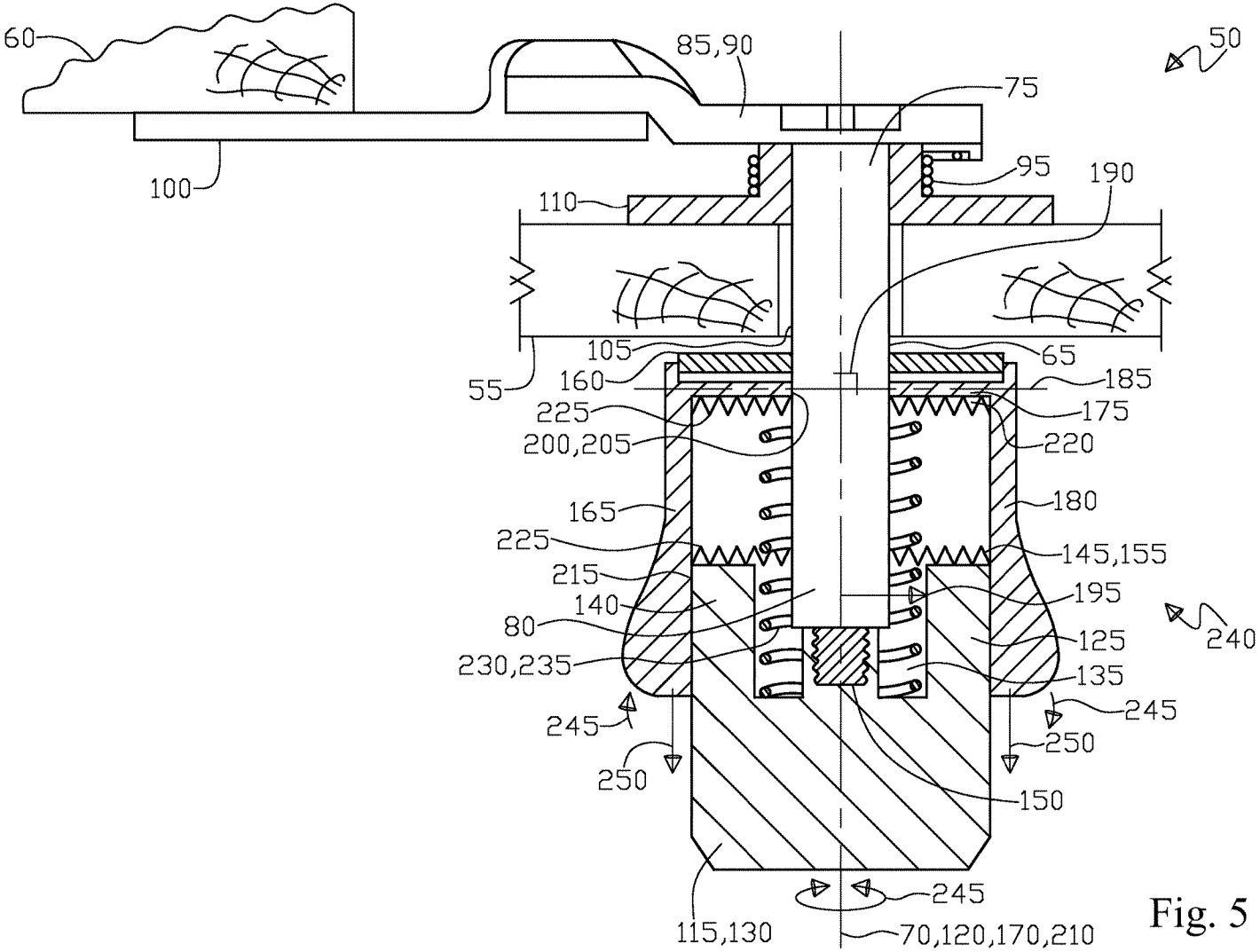
FIG. 5 shows cross section cut view 5-5 from FIG. 2 of the door security apparatus that includes portions of the door and the door frame, with the door frame affixed to the receiver and the door affixed to a bushing plate with the rotational spring that acts to rotationally bias manual motion toward engaging the door to the door frame as shown, in addition shown is the separated state of the cap and the cover that allows for a free movement as between the cover and the cap to the extension beam and finally to the means for removably engaging the extension beam that is shown as a latch, further the co-axial positioning of the longitudinal axis, the longwise axis, and the lengthwise axis are shown, also shown is the first and second teeth that are removably disengaged from one another via the means for biasing the cap and cover apart from one another along the lengthwise and longwise axes.

Continuing, FIG. 5 shows cross section cut view 5-5 from FIG. 2 of the door security apparatus 50 that includes portions of the door 55 and the door frame 60, with the door frame 60 affixed to the receiver 100 and the door 55 affixed to a bushing plate 110 with the rotational spring 95 that acts to rotationally bias manual motion 260 toward engaging the door 55 to the door frame 60 as shown. In addition, FIG. 5 shows the separated state 240 of the cap 115 and the cover 165 that allows for a free movement 245 as between the cover 165 and the cap 115 to the extension beam 65 and finally to the means 85 for removably engaging the extension beam 65 that is shown as a latch 90. Also, FIG. 5 shows the co-axial positioning 210 of the longitudinal axis 70, the longwise axis 170, and the lengthwise axis 120, also shown is the first 155 and second 220 teeth that are removably disengaged 225 from one another via the means 230 for biasing the cap 115 and cover 165 apart from one another along the lengthwise 120 and longwise 170 axes.

Figure 6:
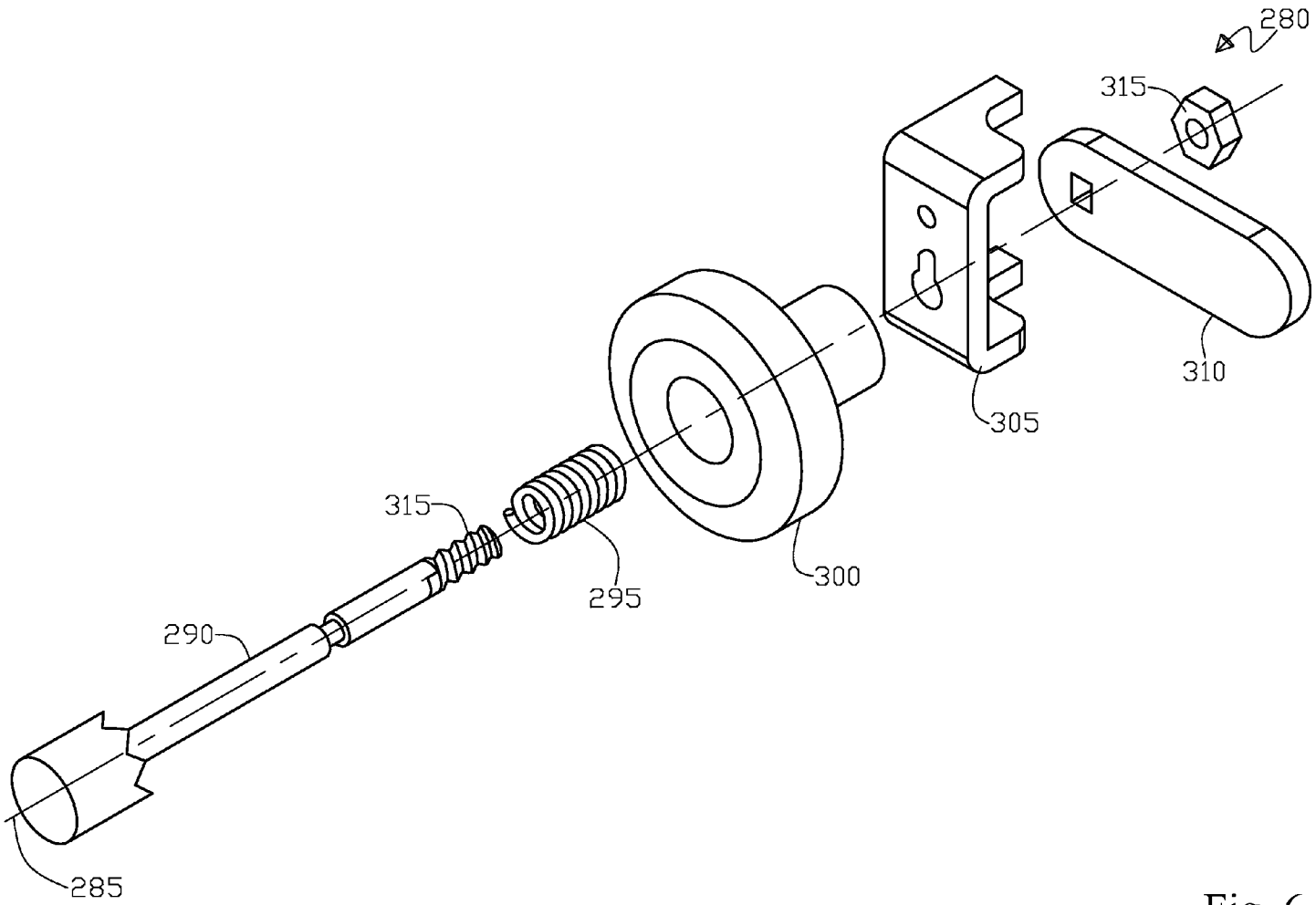
FIG. 6 shows an exploded perspective view of an alternative embodiment of the door security apparatus that includes a rotational axis, a shouldered rod, a wound spring, a knob, a bracket for the door, a tab for removably engaging the door frame, and a fastener for attaching the shouldered rod and the tab.

Next, FIG. 6 shows an exploded perspective view of an alternative embodiment 280 of the door security apparatus 50 that includes the rotational axis 285, the shouldered rod 290, the wound spring 295, the knob 300, the bracket 305 for the door 55, the tab 310 for removably engaging the door frame 60, and the fastener 315 for attaching the shouldered rod 290 and the tab 310. Continuing, FIG. 7 shows a side elevation view of the FIG. 6 alternative embodiment 280 of the door security apparatus 50 that includes the rotational axis 285, the shouldered rod 290, the knob 300, the bracket 305 for the door 55, the tab 310 for removably engaging the door frame 60, and the fastener 315 for attaching the shouldered rod 290 and the tab 310.

Figure 7:
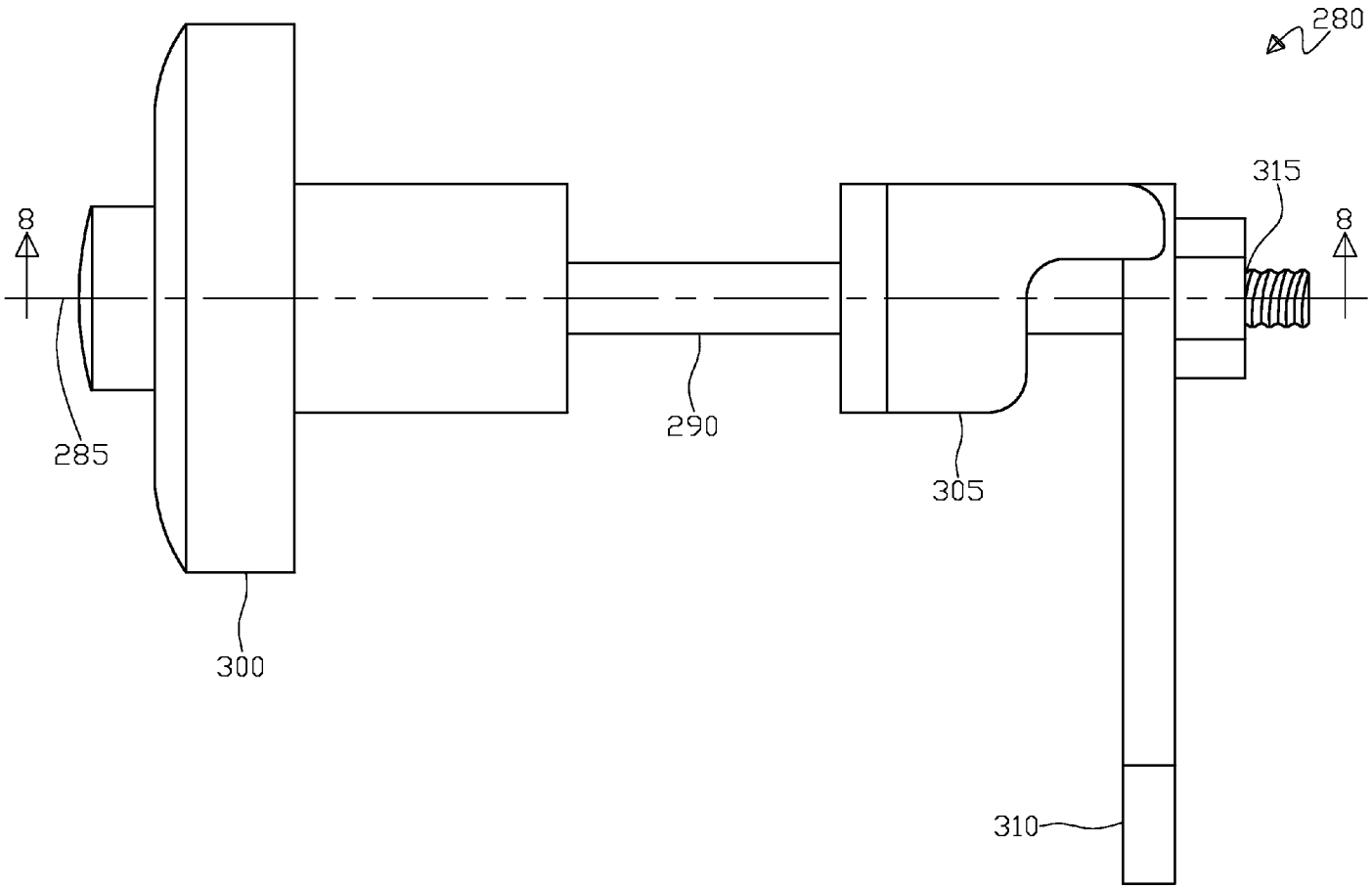
FIG. 7 shows a side elevation view of the FIG. 6 alternative embodiment of the door security apparatus that includes the rotational axis, the shouldered rod, the knob, the bracket for the door, the tab for removably engaging the door frame, and the fastener for attaching the shouldered rod and the tab.
Figure 8:
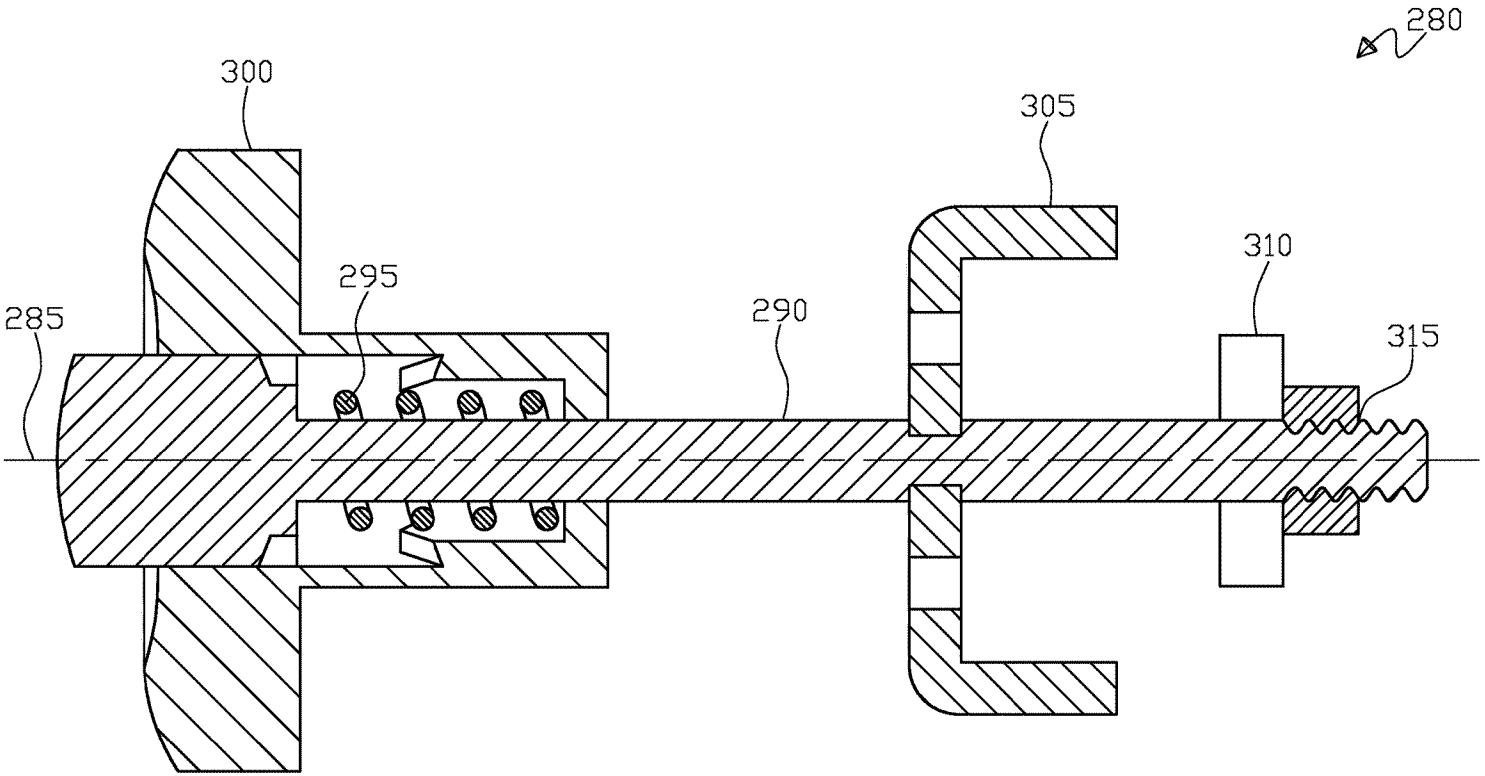
FIG. 8 shows a cross sectional view 8-8 from FIG. 7 of the alternative embodiment of the door security apparatus that includes the rotational axis, the shouldered rod, the wound spring, the knob, the bracket for the door, the tab for removably engaging the door frame, and the fastener for attaching the shouldered rod and the tab.
Figure 9:
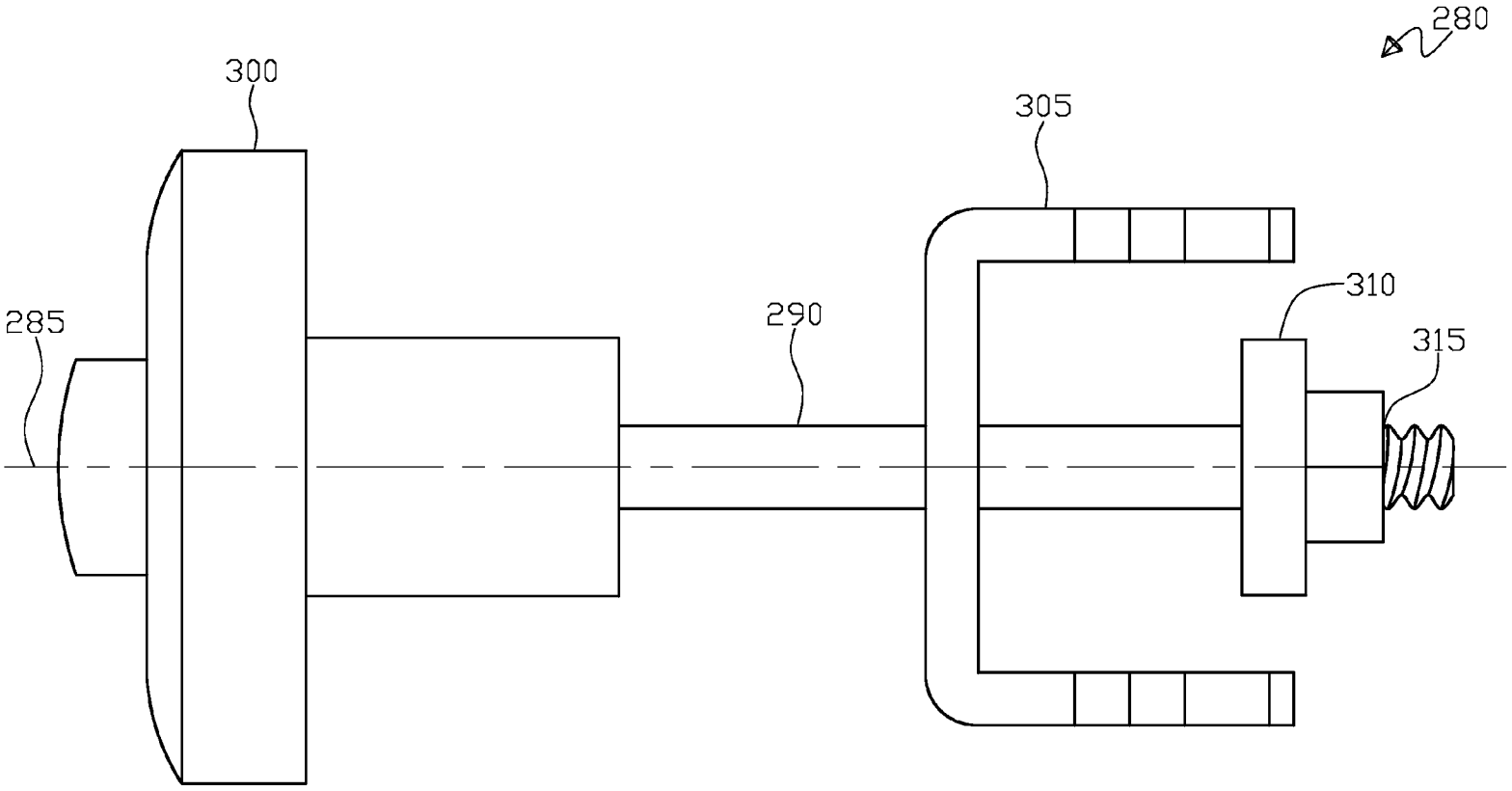
FIG. 9 shows a side elevation view from FIG. 8 of the alternative embodiment of the door security apparatus that includes the rotational axis, the shouldered rod, the knob, the bracket for the door, the tab for removably engaging the door frame, and the fastener for attaching the shouldered rod and the tab.
Figure 10:
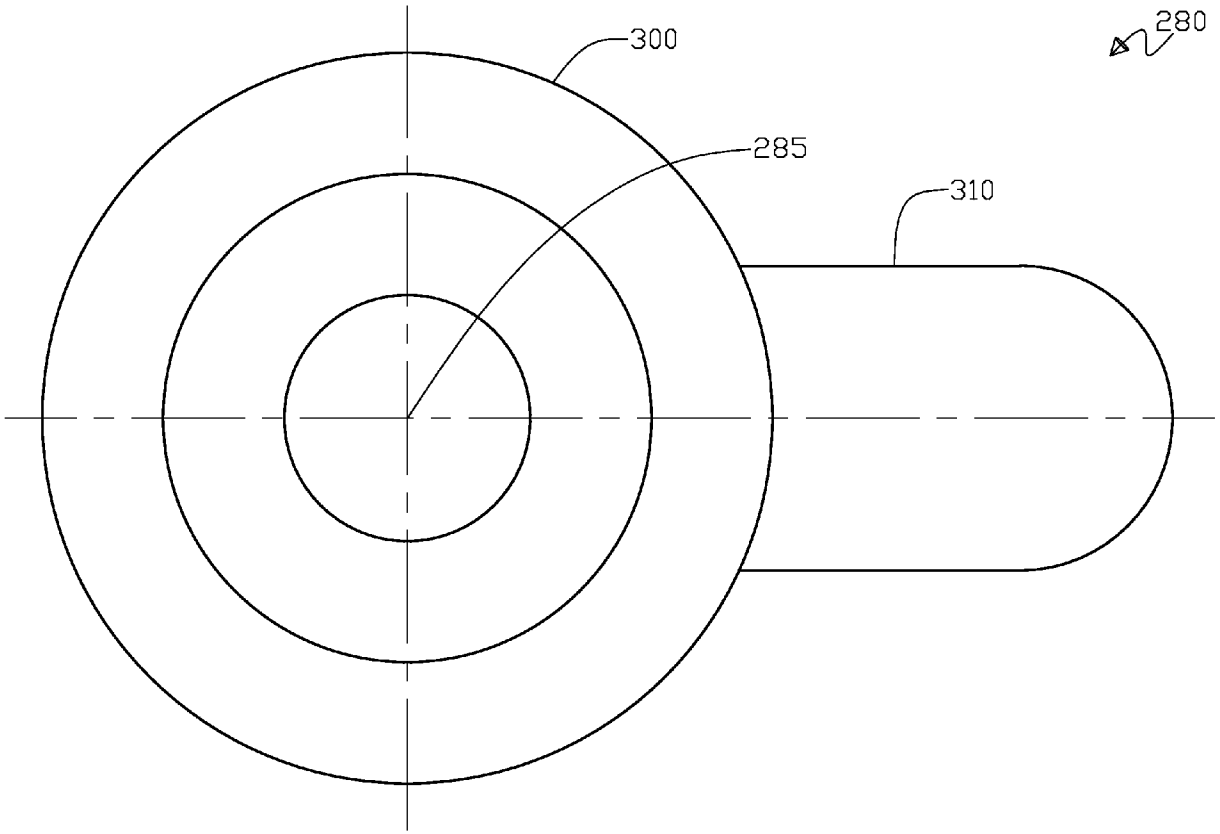
FIG. 10 shows end view 10-10 from FIG. 9 of the alternative embodiment of the door security apparatus that includes the knob, the rotational axis, and the tab.

Yet further, FIG. 8 shows a cross sectional view 8-8 from FIG. 7 of the alternative embodiment 280 of the door security apparatus 50 that includes the rotational axis 285, the shouldered rod 290, the wound spring 295, the knob 300, the bracket 305 for the door 55, the tab 310 for removably engaging the door frame 60, and the fastener 315 for attaching the shouldered rod 290 and the tab 310. Next, FIG. 9 shows a side elevation view from FIG. 8 of the alternative embodiment 280 of the door security apparatus 50 that includes the rotational axis 285, the shouldered rod 290, the knob 300, the bracket 305 for the door 55, the tab 310 for removably engaging the door frame 60, and the fastener 315 for attaching the shouldered rod 290 and the tab 310. Continuing, FIG. 10 shows end view 10-10 from FIG. 9 of the alternative embodiment 280 of the door security apparatus 50 that includes the knob 300, the rotational axis 285, and the tab 310.

Broadly, the present invention is of the door security apparatus 50 that is for securing a door 55 to a door frame 60, as best shown in FIGS. 4 and 5. The door security apparatus 50 includes an extension beam 65 having a longitudinal axis 70, with the extension beam 65 having a first end portion 75 and an opposing second end portion 80, and with the longitudinal axis 70 spanning therebetween the first end portion 75 and the second end portion 80, see in particular FIG. 1. Also, included in the door security apparatus 50 is a means 85 for removably engaging the extension beam 65 first end portion 75 to the door frame 60, that is preferably in the form of a latch 90, see FIGS. 1 to 5.

Further included in the door security apparatus 50 is a means 105 for slidably engaging the extension beam 65 first end portion 75 to the door 55, wherein the means 105 is preferably in the form of a bushing plate 110 that secures the door 55 to the extension beam 65 first end portion 75, however, with this securing still allowing manual movement 260, and reverse manual movement 270 about the longitudinal axis 70, all in relation to the door 55, see in particular FIGS. 1, 4, and 5. In addition, in the door security apparatus 50 there is a cap 115 having a lengthwise axis 120, the cap 115 including a distal end portion 125 and an opposing proximal end portion 130 with the lengthwise axis 120 spanning therebetween, see FIGS. 1, 4, and 5.

The cap 115 distal end portion 125 includes a void 135 that is disposed therein, the void 135 being defined by the proximal end portion 130 and a cap surrounding sidewall 140 extending from the proximal end portion 130 wherein the surrounding sidewall 140 terminates at an extent 145 of the distal end portion 125, see FIGS. 1, 4, and 5. The longitudinal axis 70 and the lengthwise axis 120 are co-axially positioned 210 to one another with the cap 115 proximal end portion 130 affixed 150 to the extension beam 65 second end portion 80 that is disposed within the void 135, with the extent 145 including a first tooth 155, again see FIGS. 1, 4, and 5.

In addition, the door security apparatus 50 includes a cover 165 having a longwise axis 170, the cover 165 including a base 175 and a cover surrounding sidewall 180 extending from the base 175, wherein the base 175 forms a base plane 185 with the base plane 185 being positioned perpendicular 190 to the longwise axis 170 and the cover surrounding sidewall 180 being about 195 the longwise axis 170, see FIGS. 1, 4, and 5. The cover 165 base 175 having an aperture 200 therethrough that the extension beam 65 second end portion 80 is slidably disposed 205 within the aperture 200, see FIGS. 1, 4, and 5. Also, the longwise axis 170 and the longitudinal axis 70 are co-axially positioned 210 to one another and a portion 215 of the cover 165 surrounding sidewall 180 is slidably engaged outside of a portion of the cap surrounding sidewall 140, see FIGS. 2, 4, and 5. In addition, a second tooth 220 is disposed on the base 175, wherein the second tooth 220 is removably engagable 225 to the first tooth 155, see FIGS. 4 and 5. The cover 165 can have a washer 160 disposed as between the door 55 and the base 175 to reduce friction as between the door 55 and the base 175, see FIGS. 1, 2, 4, and 5.

Further included in the door security apparatus is a means 230 for biasing the cap 115 and cover 165 apart from one another along the lengthwise 120 and longwise axes 170, the means 230 is preferably an axial spring 235, see FIGS. 1, 4, and 5. Wherein, referring to FIGS. 1 to 5, operationally when the cap 115 and the cover 165 are apart 240 from one another the first tooth 155 and the second tooth 220 are disengaged 225 thus the cap 115 and the cover 165 move freely 245 in relation to one another, see in particular FIG. 5. Wherein, when the cover 165 is manually pulled 250 toward the cap 115 along the lengthwise 120 and longwise 170 axes the first tooth 155 and the second tooth 220 removably engage 225 one another to achieve the together state 255, see in particular FIG. 4, thus facilitating a manual motion 260 to transmit from the cover 165 to the cap 115 and ultimately the motion to transmit to the extension beam 65 to accommodate engaging 265 the door 55 to the door frame 60, see FIGS. 3 and 4. Plus, with a reverse motion 270 to accommodate disengaging 275 the door 55 from the door frame 60, see FIGS. 3 and 4. Thus, the door security apparatus 50 requiring two independent manual movements being the pulling movement 250 and the motion 260, 270 being required to engage 265 and disengage 275 the door 55 from the door frame 60.

Optionally, for the door security apparatus 50 for securing the door 55 to the door frame 60, wherein preferably the first tooth 155 and the second tooth 220 are each constructed of a serrated configuration, as shown in FIGS. 1, 4, and 5. Further, optionally for the door security apparatus 50 for securing the door 55 to the door frame 60, wherein the serrated first 155 and second 220 teeth are disposed in a preferred matching peripheral removably engaging plurality of the first 155 and 220 second teeth, as best shown in FIGS. 1, 4, and 5. In addition, alternatively for the door security apparatus 50 for securing the door 55 to the door frame 60, wherein the means 230 for biasing the cap 115 and cover 165 apart is preferably constructed of an axial spring 235, see FIGS. 1, 4, and 5

CONCLUSION

Accordingly, the present invention of a door security apparatus has been described with some degree of particularity directed to the embodiments of the present invention. It should be appreciated, though; that the present invention is defined by the following claim construed in light of the prior art so modifications or changes may be made to the exemplary embodiments of the present invention without departing from the inventive concepts contained therein.

The invention claimed is:

1. A door security apparatus for securing a door to a door frame, said door security apparatus comprising:

(a) an extension beam having a longitudinal axis, said extension beam having a first end portion and an opposing second end portion, with said longitudinal axis spanning therebetween said first end portion and said second end portion;

(b) a means for removably engaging said extension beam first end portion to the door frame;

(c) a means for slidably engaging said extension beam first end portion to the door;

(d) a cap having a lengthwise axis, said cap including a distal end portion and an opposing proximal end portion with said lengthwise axis spanning therebetween said distal end portion and said proximal end portion, said distal end portion including a void disposed therein, said void being defined by said proximal end portion and a cap surrounding sidewall extending from said proximal end portion wherein said surrounding sidewall terminates at an extent of said distal end portion, said longitudinal axis and said lengthwise axis are co-axially positioned to one another with said cap proximal end portion affixed to said extension beam second end portion that is disposed within said void, said extent including a first tooth;

(e) a cover having a longwise axis, said cover including a base and a cover surrounding sidewall extending from said base, wherein said base forms a base plane with said base plane being positioned perpendicular to said longwise axis and said cover surrounding sidewall being about said longwise axis, said cover base having an aperture therethrough that said extension beam second end portion is slidably disposed within said aperture, said longwise axis and said longitudinal axis are co-axially positioned to one another and a portion of said cover surrounding sidewall is slidably engaged outside of a portion of said cap surrounding sidewall, a second tooth disposed on said base, wherein said second tooth is removably engagable to said first tooth; and (f) a means for biasing said cap and cover apart from one another along said lengthwise and longwise axes, wherein operationally when said cap and said cover are apart from one another, said first tooth and said second tooth are disengaged thus said cap and said cover move freely in relation to one another, wherein when said cover is manually pulled toward said cap along said lengthwise and longwise axes said first tooth and said second tooth removably engage one another facilitating a manual motion to transmit from said cover to said cap and ultimately said motion to transmit to said extension beam to accommodate engaging the door to the door frame and with a reverse motion to accommodate disengaging the door from the door frame, thus said door security apparatus requiring two independent manual movements being said pulling movement and said motion being required to engage and disengage the door from the door frame.

2. A door security apparatus for securing a door to a door frame according to claim 1 wherein said first tooth and said second tooth are each constructed of a serrated configuration.

3. A door security apparatus for securing a door to a door frame according to claim 2 wherein said serrated first and second teeth are disposed in a matching peripheral removably engaging plurality of said first and second teeth.

4. A door security apparatus for securing a door to a door frame according to claim 3 wherein said means for biasing said cap and cover apart is constructed of an axial spring.

* * * * *